United States Patent [19]

Prichard

[11] Patent Number: 4,759,199

[45] Date of Patent: Jul. 26, 1988

[54] LINEAR MOTION LOOPER APPARATUS FOR TUFTING MACHINE

[75] Inventor: Richard J. Prichard, Hixson, Tenn.

[73] Assignee: Tuftco Corporation, Chattanooga, Tenn.

[21] Appl. No.: 98,630

[22] Filed: Sep. 21, 1987

[51] Int. Cl.[4] ..... D05C 15/22

[52] U.S. Cl. ..... 112/80.5

[58] Field of Search ..... 112/80.5, 80.51, 80.52

[56] References Cited

U.S. PATENT DOCUMENTS 3,919,953 11/1975 Card ..... 112/80.52

FOREIGN PATENT DOCUMENTS 1541074 2/1979 United Kingdom ..... 112/80.5

*Primary Examiner*—Ronald Feldbaum

*Attorney, Agent, or Firm*—Harrington A. Lackey

[57] ABSTRACT

A looper apparatus for a multiple tufting machine including a looper support member having a transverse hook bar for supporting a plurality of looper hooks for cooperation with the reciprocable needles in the tufting machine and an elongated guide member reciprocably supported in linear bearings to restrict the motion of the looper hooks to a straight linear direction substantially parallel to the feeding direction of the base fabric, and a drive mechanism pivotally connected to hook support member for reciprocably driving the support member in a linear path.

5 Claims, 3 Drawing Sheets

LINEAR MOTION LOOPER APPARATUS FOR TUFTING MACHINE

BACKGROUND OF THE INVENTION

This invention relates to a looper apparatus for a tufting machine, and more particularly to a looper apparatus for imparting linear motion to the looper hooks.

Heretofore, looper apparatus for tufting machines have been designed to impart limited arcuate, reciprocable motion to the looper hooks, whether they are cut pile hooks or loop pile hooks.

One looper apparatus which is predominantly used in multiple tufting machines on the market today includes a looper bar supporting the looper hooks and in turn supported upon a curved rocker arm the lower end of which is journaled about an idler or looper shaft. Reciprocable motion is imparted to the curved rocker arm by a reciprocable looper shaft or rock shaft which is reciprocably driven, and which is pivotally linked to the rocker arm. The degree of arcuate motion of the looper hooks is determined by the radial distance between the looper hooks and the axis of the lower idler shaft. In order to minimize the curvature of the arcuate travel of the looper hooks, the idler shaft must be located as far away from the looper hooks as possible in order to increase the radius. This involves locating the idler shaft as low as possible in the machine and maintaining the idler shaft in substantial vertical alignment with the reciprocable path of the needles.

The greater the radial distance between the looper hooks and the axis of the idler shaft, the greater the mass of the rocker arm and other cooperative elements. The greater the mass of the moving parts, the greater energy requirements for driving the rocker arm, the greater opportunity for vibration of the moving parts, and the greater is the obstruction in the lower part of the machine to maintain and service the machine.

Some examples of prior tufting machines incorporating the above-described looper apparatus including a rocker arm for the driving of the loop pile hooks are the following U.S. Pat. Nos.:

| | | |
|---|---|---|
| 3,633,523 | R.T. Card | Jan. 11, 1972 |
| 3,919,953 | R.T. Card et al | Nov. 18, 1975 |
| 4,301,752 | Gary L. Ingram et al | Nov. 24, 1981 |
| 4,369,720 | Max M. Beasley | Jan. 25, 1983 |

SUMMARY OF THE INVENTION

It is therefore an object of this invention to provide a tufting machine having a looper apparatus for moving the looper hooks in a reciprocable, substantially straight linear path for cooperation with the corresponding needles to produce a uniform level of tufting.

Another object of this invention is to provide a looper apparatus for a tufting machine which will minimize the vibration of the moving parts in the looper apparatus.

Another object of this invention is to provide a looper apparatus for a tufting machine in which the moving parts have less mass than the moving parts of conventional looper apparatus.

A further object of this invention is to provide a looper apparatus for a multiple needle tufting machine with fewer parts occupying the space directly beneath the needles, and to create more room in the lower portion of the tufting machine to facilitate maintenance and service of the looper elements, and in the case of a cut pile tufting machine, the cutting elements.

Another object of this invention is to provide a looper apparatus for a multiple needle tufting machine permitting operation of the tufting machine at higher speeds.

The looper apparatus for a multiple needle tufting machine made in accordance with this invention includes a hook support member comprising a transverse hook bar upon which are mounted a plurality of conventional looper hooks for cooperation with the needles, and a plurality of elongated guide members or guide rods reciprocably supported in linear bearings to restrict the movement of the hook bar and looper hooks to a straight, longitudinal path substantially parallel to the feed direction of the base fabric. A linearly movable hook support member is driven through pivotal linkage by a reciprocal rotary hook shaft or jack shaft in timed relation with the reciprocal needles and the movement of the base fabric, and also with the reciprocable movement of the knives in a cut pile tufting machine.

DESCRIPTION OF THE PREFERRED EMBODIMENT

Figure 1:
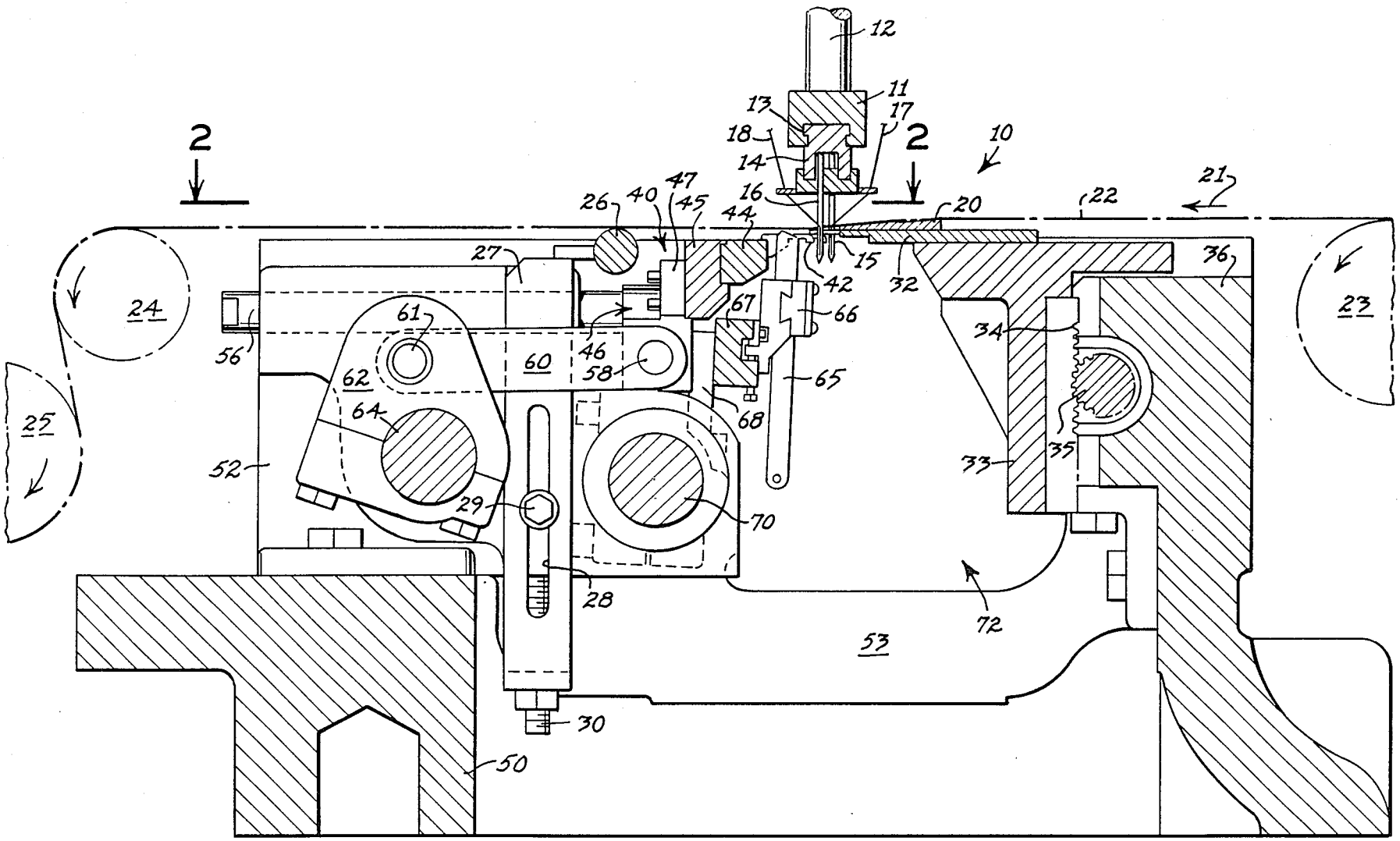
FIG. 1 is a fragmentary sectional elevation of a portion of a cut pile tufting machine incorporating a looper apparatus made in accordance with this invention and illustrating the looper hooks in a retracted, inoperative position.

Referring now to the drawings in more detail, FIG. 1 discloses a multiple needle cut pile tufting machine 10 including a transverse needle bar holder 11 fixed to a vertically reciprocable push rod 12 and including a transverse slide groove 13 for transversely slidably receiving the needle bar 14. The needle bar 14 is illustrated as supporting a plurality of transversely staggered front needles 15 and rear needles 16. Each of the front needles 15 is supplied with a yarn 17, while each of the rear needles 16 is supplied with a yarn 18 from yarn supply means, not shown.

The push rod 12 is adapted to be vertically driven by needle drive means, not shown, in a conventional manner.

Supported upon a needle plate 20 for longitudinal movement from front-to-rear in a feeding direction, indicated by the arrow 21, through the tufting machine 10 is a base fabric 22. The base fabric 22 is fed in the feed direction 21 by the fabric feed rolls 23, 24, and 25 in a conventional manner. Moreover, the base fabric 22 may also be supported upon the transverse fabric support bar 26, if desired. The transverse fabric support bar 26 is mounted on standards 27 having elongated slots 28 therein for receiving fixed guide pins or bolts 29 fixed to the frame of the machine 10. The elevation of the fabric support bar 26 may be adjusted by means of the adjustment bolt 30 extending through a corresponding aperture in the bottom frame bar 31 and threadedly secured in a corresponding opening in the bottom of the frame of the machine 10, all in a conventional manner.

The needle plate 20 is supported upon a mounting plate 32 and frame 33 which includes a vertical rack 34 operatively engaging a gear 35 rotatably mounted within the bed frame 36. By manually rotating the gear or gears 35 by conventional means, not shown, the needle plate 14 is vertically adjusted to the proper elevation for supporting the base fabric 22.

The needle plate 20 and the fabric support bar 26 are preferably vertically adjusted so that that portion of the support bar 26 is generally in a horizontal plane and in a position to be penetrated be the needles 15 and 16 on the downstroke of the needle bar 14.

The looper apparatus 40 made in accordance with this invention includes a plurality of first long cut pile hooks 41 alternating with a plurality of second short cut pile hooks 42, all of which are preferably uniformly spaced, but in any event, spaced at the same gauge as the needles 15 and 16 within corresponding slots, not shown, in the hook bar 44 so that each of the cut pile hooks 41 and 42 may cooperate with the corresponding needles 15 and 16 in a conventional manner, for seizing the yarns 17 and 18 respectively carried through the base fabric 22 in order to form corresponding loops.

Figure 2:
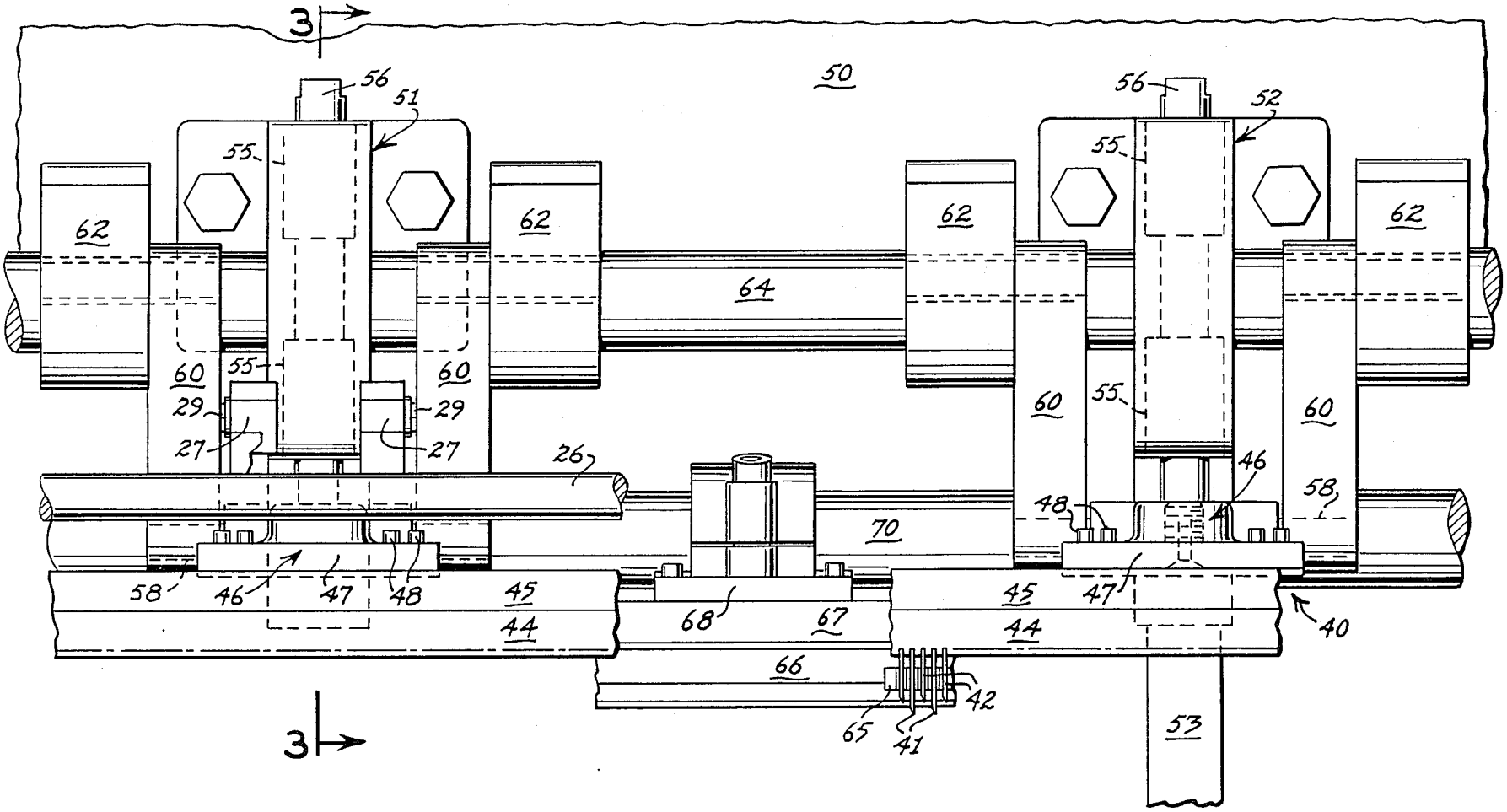
FIG. 2 is an enlarged fragmentary plan section taken along the line 2-2 of FIG. 1, with portions broken away.
Figure 4:
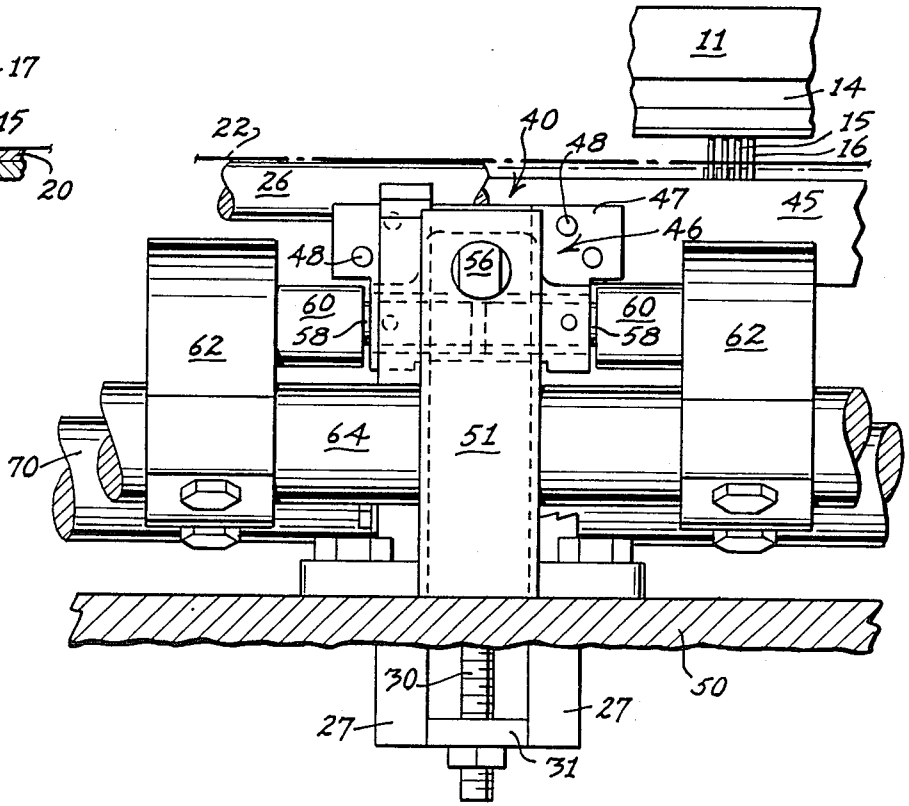
FIG. 4 is a fragmentary rear elevational sectional view taken along the line 4-4 of FIG. 3, with portions broken away.

The hook bar 44 is elongated transversely and may be made in sections, if desired. The hook bar 44 is secured in a transversely extending hook mounting bar 45, which in turn is supported upon a plurality of transversely spaced drive blocks or heads 46, two of which are shown in FIG. 2. Each drive block 46 is provided with an upper flange 47 to fit flush against the rear of the hook mounting bar 45 and is provided with a plurality of holes to receive bolts 48 for attaching the drive block 46 to the mounting bar 45.

Mounted upon the machine frame 50 at transversely spaced intervals are a plurality of bearing support blocks 51 and 52. Each of the bearing support blocks 52 is provided with a longitudinal cross member 53 for extending from the front to the rear portion of the frame for added support.

Figure 3:
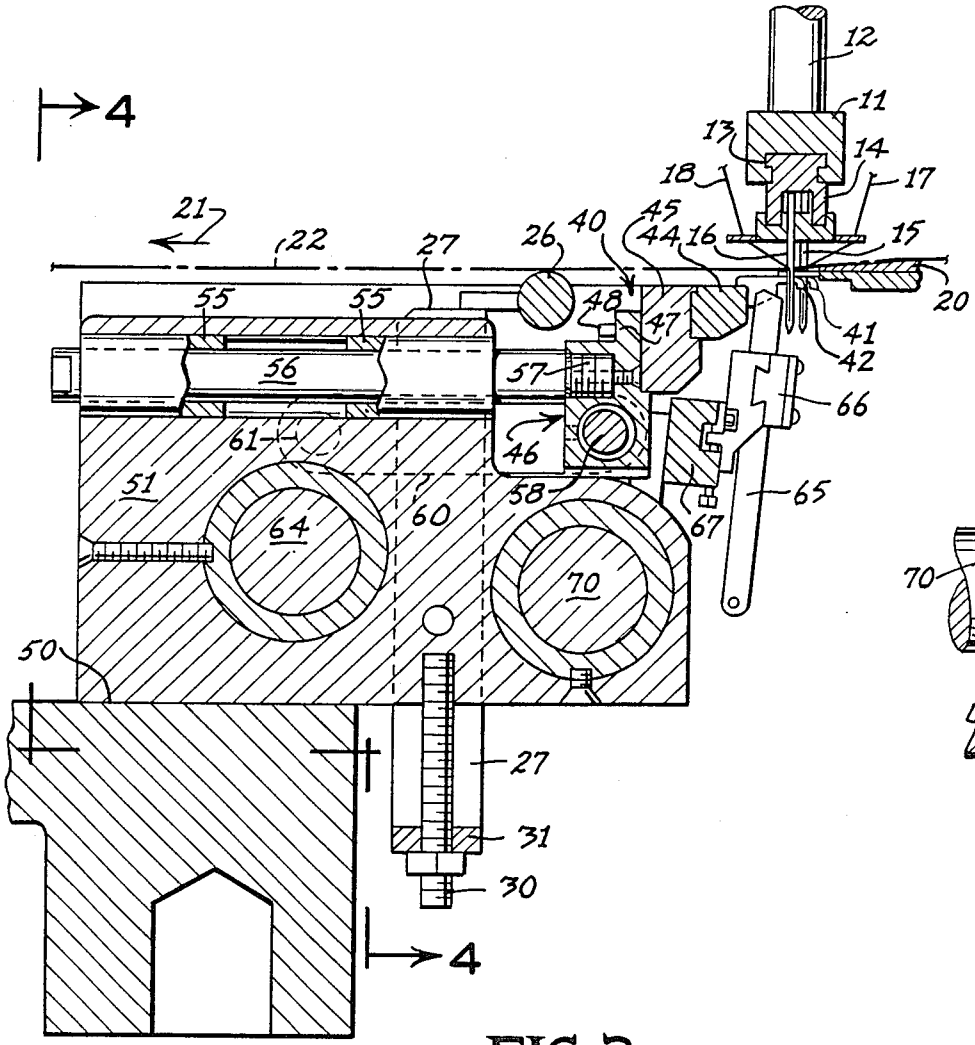
FIG. 3 is a fragmentary sectional elevation taken along the line 3-3 of FIG. 2.

Each of the bearing support blocks 51 and 52 is provided with a pair of front-to-rear longitudinally spaced linear bearings 55 slidably receiving an elongated guide member or guide rod 56. The linear bushings or bearings 55 are preferably of the re-circulating ball bushing type, such as "Thomson bearings". The front end portion 57 of each guide rod 56 is threaded to be threadedly received within a corresponding socket within the body of the drive block 46, as shown in FIG. 3. The length of the guide rod 56 is great enough that it will always be retained in the two front and rear linear bearings 55 regardless of the extent of the longitudinal travel of the hook bar 44.

Journaled to the opposite sides of the lower portion of the body of the drive block 46 by pivot pins 58 are the front end portions of link bars 60. The rear end portions of the link bars 60 are journaled by pivot pins 61 to corresponding radial arm members 62 fixed on opposite sides of each of the bearing support blocks 51 or 52 to a driven reciprocable rotary looper or jack shaft 64. The rear pivot pin 61 is radially spaced from the rotary axis of the looper shaft 64 to impart linear motion to the guide rod 56 from the rotary motion of the looper shaft 64. The looper shaft 64 is driven to reciprocate in a limited rotary movement by conventional drive means, not shown. Moreover, the drive means for the looper shaft is synchronized with the needle drive means for the push rod 12.

Adapted to cooperate with each of the cut pile hooks 41 and 42 is a knife 65 mounted in a knife holder 66 supported upon a transverse knife block 67, which in turn is supported upon a knife bracket 68 fixed to the reciprocably rotatable transverse knife shaft 70.

It will be understood that the looper apparatus 40 made in accordance with this invention may be used with loop pile hooks if desired. In this instance, no knives or cutting apparatus would be required, and furthermore, the looper apparatus 40 would be mounted in the front part of the machine for reciprocating the loop pile hooks which would be pointing in the opposite direction from the cut pile hooks 41 and 42, that is in the direction of the fabric feed 21.

It is also within the scope of this invention to utilize the looper apparatus 40 for in-line needles, as well as the staggered needles 15 and 16 disclosed in the drawings.

As disclosed in FIG. 1, the needle bar 14 is slidably mounted transversely within the needle bar holder 11 to permit transverse reciprocable movement by virtue of a conventional needle bar shifting mechanism. The looper apparatus 40 may also be used in connection with a needle bar without the shifting capability.

By virtue of the utilization of the looper apparatus 40 made in accordance with this invention, a substantial space 72 is provided in the tufting machine 10 below the needle mounting plate 32 and between the knife shaft 70 and the front portion of the machine frame 50, this space 72 extends all the way to the floor between the cross members 53. Thus, a considerable amount of room is provided in the lower portion of the tufting machine 10 to permit access to the moving parts of the looper apparatus 40 and the knives 65 and their supporting elements for service, maintenance, and replacement of parts.

Furthermore, it will be noted that the looper apparatus 40 incorporates parts whose mass is substantially less than the mass of the moving parts of a conventional looper apparatus, including the long arcuate rocker arms.

It has been found that in the operation of the tufting machine, the machine may be operated at a higher speed and machines with conventional looper apparatus, that the vibration of the parts, and particularly parts in the looper apparatus, are substantially reduced and the completed pile tufts in the base fabric 22 are practically level and smoother than tufted pile fabric previously made by other conventional tufting machines.

What is claimed is:

1. In a tufting machine having fabric support means for supporting a base fabric for longitudinal movement in a feeding direction through said machine, and a plurality of reciprocable needles for introducing yarns through the base fabric to form loops, the needles being spaced apart substantially transversely of the feeding direction, a looper apparatus comprising:

(a) a plurality of looper hooks, there being one looper hook for each needle, (b) a hook support member comprising an elongated hook bar extending transversely of said feeding direction and mounting looper hooks in the same transverse spaced relationship as the needles and adjacent said fabric support means, (c) said hook support member further comprising an elongated guide member having opposite ends, (d) linear bearing means supporting said guide member for linear reciprocable movement substantially parallel to said longitudinal feeding direction, (e) an elongated looper shaft, (f) rotary bearing means supporting said looper shaft transversely of said feeding direction for reciprocable rotary movement, (g) arm means projecting radially from said looper shaft, and (h) connector means pivotally connecting said arm means to said hook support member to impart reciprocable linear movement to said looper hooks as said looper hooks move toward and away from said corresponding needles to form loops in the yarn carried through the base fabric by said needles.

2. The invention according to claim 1 in which said connector means comprises a link member having opposite ends, first means pivotally connecting one end of said link member to said arm means and second means pivotally connecting the other end of said link member to said hook support member.

3. The invention according to claim 2 in which said second means comprises pin means pivotally connecting said other end of said link member to said hook support member.

4. The invention according to claim 3 in which said link member comprises an elongated link bar having first and second ends, said first means comprising a first pivot pin pivotally connecting said first end of said link bar to said arm means at a radial distance from the axis of said looper shaft.

5. The invention according to claim 1 in which each of said looper hooks is a cut pile hook, said hook bar mounting said cut pile hooks to point in the opposite direction from said feeding direction, and further comprising a knife for each cut pile hook, and means supporting each said knife for reciprocable, cooperative movement with a corresponding cut pile hook to cut a corresponding loop to form a cut pile tuft.

* * * * *